United States Patent [19]

Aida

[11] 4,285,294

[45] Aug. 25, 1981

[54] UPPER LAYER FEED MECHANISM IN A SEWING MACHINE

[75] Inventor: Kikuo Aida, Tsukuimachi, Japan

[73] Assignee: Tokyo Juki Kogyo Kabushiki Kaisha, Tokyo, Japan

[21] Appl. No.: 163,625

[22] Filed: Jun. 26, 1980

[30] Foreign Application Priority Data

Jul. 4, 1979 [JP] Japan ..... 54-92329[U]

[51] Int. Cl.[3] ..... D05B 27/06

[52] U.S. Cl. ..... 112/311; 112/314; 112/320; 112/323

[58] Field of Search ..... 112/311, 314, 320, 323, 112/303

[56] References Cited

U.S. PATENT DOCUMENTS

| | | | |
|---|---|---|---|
| 1,995,945 | 3/1935 | Rubel et al. | 112/311 |
| 3,530,809 | 9/1970 | Porter | 112/311 |
| 3,636,899 | 1/1972 | Crisler | 112/311 |

FOREIGN PATENT DOCUMENTS 50-72451 6/1975 Japan .

*Primary Examiner*—H. Hampton Hunter

*Attorney, Agent, or Firm*—Wenderoth, Lind & Ponack

[57] ABSTRACT

An upper layer feed mechanism in a sewing machine is disclosed herein. The upper layer feed mechanism comprises a first interlocking arm secured at one end to a horizontal feed shaft, an upper layer feed shaft rotatably supported on the machine frame of a sewing machine and having a second interlocking arm, a connector rod connecting between the first and second interlocking arms, an adjusting mechanism adjusting the connection between the second interlocking arm and connector rod, a support arm rotatably supported at one end on the machine frame, an upper layer feed arm rotatably supported at one end on the support arm and having an upper layer feed dog at the other end, a connection mechanism transmitting the rocking movement of the upper feed shaft to the support arm, a resilient means normally urging the upper layer feed dog downwardly and a means urging the upper layer feed dog upwardly against the resiliency of the resilient means.

2 Claims, 1 Drawing Figure

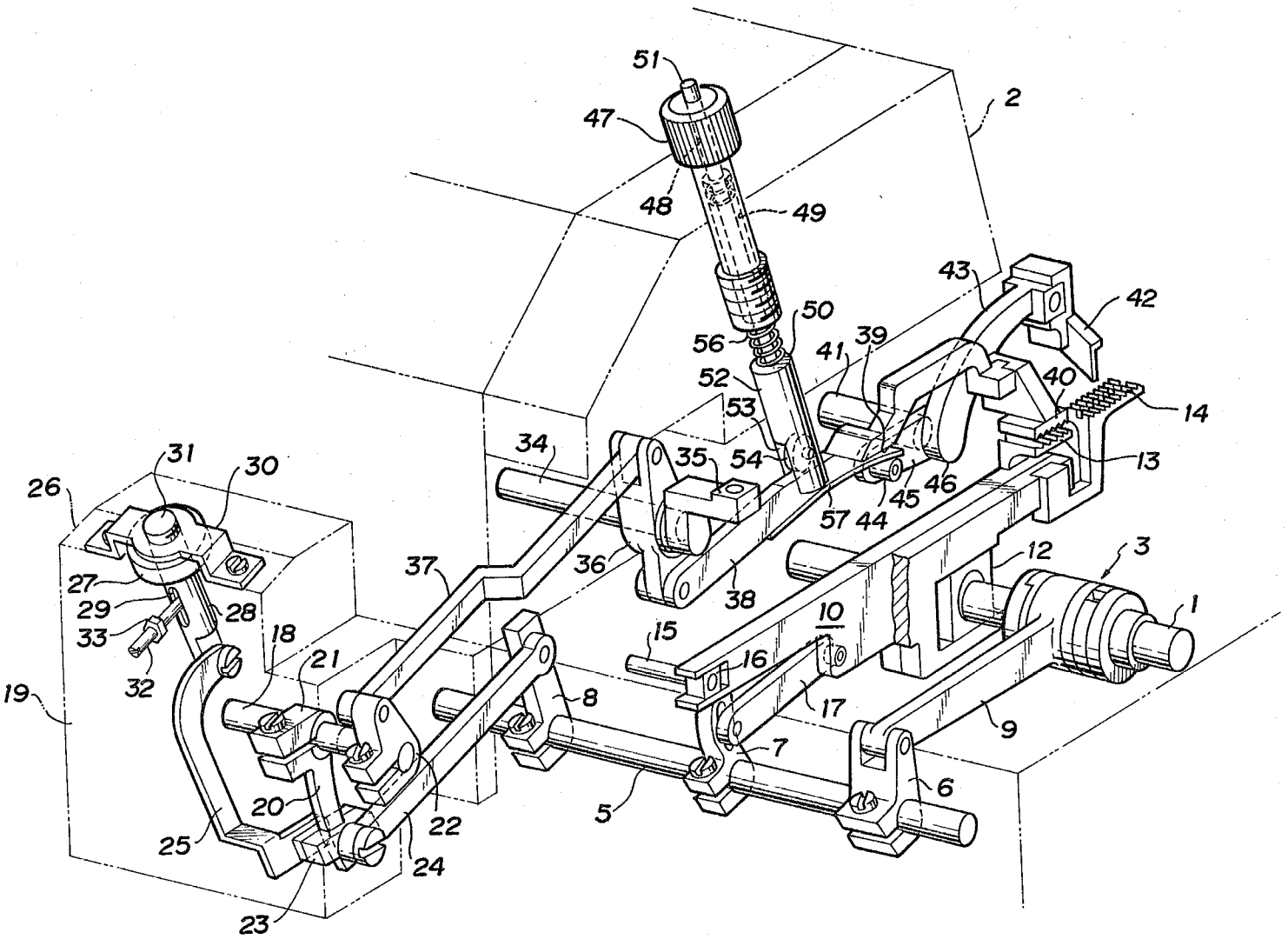
1
2
3
5
6
7
8
9
10
12
13
14
15
16
17
18
19
20
21
22
23
24
25
26
27
28
29
30
31
32
33
34
35
36
37
38
39
40
41
42
43
44
45
46
47
48
49
50
51
52
53
54
56
57

UPPER LAYER FEED MECHANISM IN A SEWING MACHINE

BACKGROUND OF THE INVENTION

This invention relates to the cloth feed mechanism disposed across the cloth advancement path in a sewing machine and more particularly, to an improved upper layer feed dog arrangement for the cloth feed mechanism disposed above and facing the cloth feed mechanism to feed the upper layer of a cloth to be sewn in cooperation with the underlying cloth feed mechanism.

One prior art upper layer feed dog arrangement of the above type is disclosed in Laid-Open Japanese Utility Model Application No. 72451/1975. However, since the prior art upper layer feed dog arrangement comprises an upper layer feed dog supported on an upper layer feed bar which is connected at the rear end to an under layer feed bar on which an under layer feed dog is supported, the upper and lower layer feed dogs which grip a cloth to be sewn therebetween have the same cloth feed amount.

However, in the sewing machine incorporating such an upper layer feed dog arrangement therein, since the cloth feed machanism comprising the pressure foot disposed on one side of the cloth advancement path in the sewing machine and the opposing feed dog disposed on the other side of the cloth advancement path in face-to-face relationship to the pressure foot is present in the sewing area and the feed amount of the upper layer of the two superimposed cloth layers to be sewn together is usually less than that of the lower layer because the upper layer is subjected to frictional resistance offered by the undersurface of the pressure foot and relative slippage between the upper and lower layers, a relative displacement tends to occur between the upper and lower layers. And such relative displacement varies depending upon the coefficient of friction of a particular cloth to be sewn.

Therefore, when the two layers of a cloth disposed one upon another are sewn together in the prior art sewing machine, the relative displacement between the upper and lower layers can not be compensated for by the upper and lower layer feed dogs resulting in a low quality cloth product and the prior art upper layer feed dog arrangement can not accommodate different types of cloth having varying coefficients of friction.

SUMMARY OF THE INVENTION

Thus, the present invention is to provide an upper layer feed mechanism in a sewing machine which can effectively eliminate the disadvantages inherent in the prior art upper layer feed mechanism.

The purpose of the present invention can be attained by providing an upper layer feed dog above and facing a lower layer feed dog disposed on one side of the cloth advancement path for moving horizontally in response to the movement of the lower layer feed dog in such a manner that the horizontal movement amount by the upper layer feed dog is adjusted relative to the horizontal movement amount by the lower feed dog.

The above and other objects and attendant advantages of the present invention will be more readily apparent to those skilled in the art from a reading of the following detailed description in conjunction with the accompanying drawing which shows one preferred embodiment of the invention for illustration purpose only, but not for limiting the scope of the same in any.

BRIEF DESCRIPTION OF THE DRAWING

The sole FIGURE of the accompanying drawing shows one preferred embodiment of the invention in a schematic perspective view for illustration purpose.

DESCRIPTION OF THE PREFERRED EMBODIMENTS

In the FIGURE, reference numeral 1 denotes a drive shaft rotatably supported in the machine frame 2 of a sewing machine in which the upper layer feed mechanism of the invention is incorporated and extending in the longitudinal direction of the frame. The drive shaft is adapted to be rotated in one direction by means of an electric motor (not shown). Mounted on the drive shaft 1 in spaced positions along the length thereof is a conventional horizontal feed adjuster 3 and an eccentric cam 4. The eccentricity of the feed adjuster 3 and eccentric cam 4 with respect to the shaft 1 can be adjusted. Reference numeral 5 denotes a horizontal feed shaft supported in the machine frame 2 in parallel to and spaced from the drive shaft 1 in the manner as will be described hereinafter. The bases of a drive arm 6 of a main feed arm 7 and of a first interlocking arm 8 are secured to the horizontal feed shaft 5 in laterally spaced positions along the length of the horizontal feed shaft 5. The other or leading end of the drive arm 6 is pivotally connected to the horizontal adjuster 3 by means of a connector rod 9 so that when the drive shaft 1 is rotated, the horizontal feed shaft 5 is rocked.

The lower layer feed mechanism which cooperates with the upper layer feed mechanism of the invention is conventional and generally comprises a main feed bar 10 and a sub-feed bar 11 freely supported in their central bifurcated portions in the length thereof on the drive shaft 1 across the cloth advancement path by means of a support block 12 which is in turn fixedly mounted on the drive shaft 1.

The leading ends of the main- and sub-feed bars 10, 11 have a main feed dog 13, and a sub-feed dog 14 secured thereto, respectively and the feed dogs 13, 14 are disposed on the opposite sides of the cloth advancement path, respectively. The bifurcated rear or base ends of the main- and sub-feed bars 10, 11 are freely mounted on a support block 16 which is in turn rotatably supported on a shaft 15 which is supported in the machine frame 2. In the drawing, the rear or base end of the sub-feed bar 11 is cut away in order to simplify the showing of the drawing.

The main feed bar 10 and the main feed arm 7 are connected to each other by means of a main feed link 17 so that when the horizontal feed shaft 5 rocks in one or the other direction, the main feed bar 10 moves horizontally in one or the other direction. Although not shown, the sub-feed bar 11 is also connected to the shaft 5 and moves horizontally in one or the other direction as the horizontal feed shaft 5 rocks in one or the other direction. The horizontal movement amount of the main- and sub-feed bars 10, 11 is adjusted separately by means of separate adjusting mechanism (not shown). Thus, the horizontal feed amount by feed dogs 13, 14 secured to the main- and sub-feed bars 10, 11 is also separately adjusted.

Reference numeral 18 denotes an upper layer feed shaft which is rotatably supported in a box-shaped member 19 which is in turn secured to the rear end face of the machine frame 2. The right-hand end portion of the shaft 18 (as seen in the drawing) protrudes out of the box-shaped member 19 and has the base of a feed arm 22 secured thereto and the opposite end portion of the shaft 18 positioned within the box-shaped member 19 has secured thereto the base of a second interlocking arm 21 which has an arcuate guide portion 20. Reference numeral 23 denotes a slider member having a through opening which is slidably fitted on the guide portion 20 of the second interlocking arm 21 for slidable movement along the guide portion 20. The slider member 23 comprises a pair of half portions having aligned mating recesses which define the through opening. The right-hand side of the slider member 23 is connected to the upper end of the first interlocking arm 8 by means of a connector rod 24 so that when the horizontal feed shaft 5 rocks the slider member 23 slidably moves along the guide portion 20 of the second interlocking arm 21 while the left-hand side of the slider member 23 has the lower end of a bent adjusting link 25 connected thereto. A ramp 26 is formed on the top surface of the box-shaped member 19 and a threaded bar 28 having an adjusting screw 27 thereon extends through the ramp 26 on the box-shaped member 19 with the flattened lower end of the threaded bar rockably supporting the upper end of the bent adjusting link 25 by means of a rivet. A key way 29 is formed in the center portion of the threaded bar 28 for the purpose to be described hereinafter.

Reference numeral 30 denotes a holding plate having a hole 31 through which the upper end portion of the threaded bar 28 extends freely and bent upwardly in the center portion thereof. The holding plate 30 is secured to the ramp 26 on the top surface of the box-shaped member 19 by means of suitable fasteners with a clearance left between the ramp 26 and the upwardly bent center portion of the holding plate 30 so that the adjusting screw 27 can be turned about the threaded bar 28 in threaded engagement with the bar so as to adjust the height of the adjusting link 25. Reference numeral 32 denotes a set screw extending through the box-shaped member 19 and the key way 29 in the threaded bar 28 and supporting a nut 33 at the leading end to secure the set screw 32 to the box-shaped member 19.

Reference numeral 34 denotes a pressure shaft rotatably supported in the machine frame 2 by means of bearings (not shown) and adapted to be manually rotated by an operator. The right-hand end of the pressure shaft 34 has a support 35 secured thereto for supporting the base of a pressure arm (not shown) having a pressure foot (not shown) at the leading end positioned above and facing the sub-foot dog 14 so that the pressure arm can rotate about a vertical axis. Reference numeral 36 denotes a support arm rotatably supported in the junction between the two legs thereof in the bearings which also rotatably support the pressure shaft 34. The bifurcated upper end of the vertical leg of the support arm is connected to the upper end of the feed arm 22 by means of an upper layer feed rod 37. Reference numeral 38 denotes an upper layer feed arm having the bifurcated base pivoted to the lower end of the support arm 36. The undersurface of the upper layer feed arm in the center portion thereof is formed with an engaging face 39 and an upper layer feed dog 40 is secured to the leading end of the upper layer feed arm 38. Reference numeral 41 denotes a knife support shaft rotatably supported in the machine frame 2 and adapted to rock in response to the rotation of the drive shaft 1 and an arm member 46 is secured to the end portion of the knife support shaft extending out of the machine frame 2. The arm member 46 is integrally formed therewith a knife support arm 43 which has a cloth cutting knife 42 at the leading end and a lift arm 45 supporting a roller 44 at the leading end for engaging the engaging face 39. Reference numeral 47 denotes an adjusting knob adapted to adjust the downward pressure applied to the upper feed dog 40. The adjusting knob 47 is screwed at the lower end in the machine frame 2 and has a smaller diameter hole 48 in the upper end portion and a larger diameter hole 49 in the lower end portion.

Reference numeral 50 denotes a pressure shaft having a reduced diameter upper end portion 52 freely received in the smaller diameter hole 48 and an enlarged diameter lower end portion 52 formed with opposite notches 53 for receiving the center portion of the upper layer feed arm 38. A roller 54 is rotatably supported in the notches 53 by means of a stub shaft 55 which is in turn supported in the enlarged end portion 52 of the pressure shaft 50. A coiled spring 56 is disposed about the pressure shaft 50 between the smaller and enlarged diameter end portions thereof so that when the adjusting knob 47 is turned, the rotation of the knob is transmitted to the roller 54 through the coiled spring 56 to thereby adjust the pressure to be applied to the upper surface of the upper layer feed arm 38 by the roller 54. Reference numeral 57 denotes a leaf spring having the base secured to the undersurface of the upper layer feed arm 38 and the leading end extending between the engaging face 39 on the upper layer feed arm 38 and the roller 44. The leaf spring 57 is adapted to move downwardly away from the engaging face 39 by its inherent resiliency and abut against the roller 44 to reduce the downward force applied to the upper feed dog 40 by the spring 56 when the knife support shaft 41 has completed its rocking movement in the counter-clockwise direction to move downwardly away from the engaging face 39 on the upper layer feed arm 38 and the upper feed dog 40 abuts against the upper surface of the upper layer of the cloth being sewn. When the knife shaft 41 rocks in the clockwise direction, the leaf spring 57 warps gradually upwardly under the action of the roller 44 to store force therein and since the stored force acts upwardly or in the opposite direction to that of the downward force of the coiled spring 56 which presses the upper layer feed arm 38 downwardly, and in fact, the force of the spring 56 acting on the upper layer feed arm 38 is reduced gradually. When the force of the spring 56 acting on the upper layer feed arm 38 is small, the upper layer feed arm 38 rotates in the counter-clockwise direction about the junction between the upper layer feed arm 38 and the support arm 36 and the upper layer feed dog 40 rises before the upper surface of the leaf spring 57 comes into contact with the engaging face 39 and when the force of the spring 56 is greater than the force stored in the leaf spring 57, the upper layer feed arm 38 rotates in the counter-clockwise direction and the upper layer feed dog member 40 rises after the upper surface at the leading end of the leaf spring 57 has come into contact with the engaging face 39.

Among the above-mentioned components of the sewing machine feed mechanism, those which project out of the machine frame 2 are only the leading ends of the main- and sub-feed bars 10, 11 including the main- and sub-feed dogs 13, 14, the lower portions of the feed arm 22, of the upper layer feed rod 37, of the support arm 36, of the upper layer feed arm 38 and of the pressure shaft 50 and the arm member 46 and all of the rest components are concealed and received in the machine frame 2 and box-shaped member 19.

With the above-mentioned construction and arrangement of the components of the upper layer feed mechanism in a sewing machine according to the present invention, in operation, when the drive shaft 1 is rotated by a drive source (not shown), the main- and sub-feed dogs 13, 14 cause the horizontal feed adjuster 3 to rock the horizontal feed shaft 5 through the rod 9 and drive shaft 6 and imparts a horizontal movement to the main- and sub-feed bars 10, 11 through the main feed arm 7 and main feed link 17. And the eccentric cam 4 imparts an upward and downward movement to the main- and sub- feed bars 10, 11. This composite movement causes the main- and sub-feed dogs 13, 14 to move for feeding the cloth being sewn. By adjusting the horizontal feed adjuster 3, the rocking amount by the horizontal feed shaft 5 is varied to thereby adjust the cloth feed amount by the main feed dog 13. The cloth feed amount by the sub-feed dog 14 in the horizontal direction can be also varied by a separate adjusting mechanism (not shown).

The rocking movement of the horizontal feed shaft 5 is transmitted to the rocking member 23 through the first interlocking arm 8 and connector rod 24 and also rocks the upper layer feed shaft 18 through the guide portion 20 of the second interlocking arm 21. When the slider member 23 rocks, the adjusting link 25 rocks about the junction between the adjusting link 25 and the lower end of the threaded bar 28. Furthermore, the rocking movement of the upper layer feed shaft 18 rocks the support arm 36 about the shaft 15 on the pressure shaft 34 through the feed arm 22 and upper layer feed rod 37 whereby a horizontal movement is imparted to the upper layer feed arm 38 in the cloth feed direction. At this time, the force of the spring 56 causes the roller 54 which abuts against the upper surface of the upper layer feed arm 38 to rotate so as to allow the upper layer feed arm 38 to move horizontally.

When the arm member 46 on the knife support shaft 41 rocks in the clockwise direction in response to the rotation of the drive shaft 1, the knife support arm 43 cuts the cloth edge by the cloth cutting knife 42 at the leading end thereof and on the other hand, the upper layer arm 45 causes the leaf spring 57 to warp by means of the roller 44 and causes the upper layer feed arm 38 to rotate about the junction between the upper layer feed arm 38 and the support arm 36 against the force of the spring 56 to raise the upper layer feed dog 40. When the arm member 46 rocks in the clockwise direction, the cloth cutting knife 42 rises, the upper layer feed arm 38 rocks in the clockwise direction against the force of the spring 56 and the upper feed dog 40 descends down in the reverse way.

The horizontal reciprocal movement of the arm member 46 as the result of the rocking movement of the support arm 36 in response to the movement of the horizontal feed shaft 5 and the reciprocal movement of the upper layer feed arm 38 as the result of the rocking movement of the arm member 38 cause the upper feed dog 40 to move on the upper surface of the cloth upper layer to feed the upper cloth layer and the timing of the main- and sub-feed dogs 13, 14 is so selected that when the main- and sub-feed dogs 13, 14 descend from the throat plate (not shown) the upper layer feed dog 40 rises from the upper surface of the cloth and when the descended main- and sub-feed dogs 13, 14 return in the direction opposite to the feed direction, the risen upper feed dog 40 also moves in the same direction and when the main- and sub-feed dogs 13, 14 rise, the upper feed dog 40 descends to grip the cloth in cooperation with the main feed dog 13, and when the main- and sub-feed dogs 13, 14 rise and move in the cloth feed direction, the upper layer feed dog also moves in the same direction.

In order to vary the cloth feed amount by the upper layer feed dog 40 with respect to that by the main feed dog 13, it is only necessary to turn the adjusting screw 27 to obtain a desired cloth feed amount for the upper layer feed dog 40. That is, since the upper surface and undersurface of the adjusting screw 27 face the holding plate 30 and the ramp 26, respectively, the threaded bar 28 moves upwardly or downwardly by turning the adjusting screw 27 in one or the other direction so that the upward or downward movement of the threaded bar moves the slider member 23 upwardly or downwardly along the guide portion 20 of the second interlocking arm 21 through the adjusting link 25. Thus, as a result, the distance from the axis of the upper layer feed shaft 18 to the junction between the slider member 23 and the connector rod 24 varies and the rocking angle of the upper layer feed shaft 18 with respect to a predetermined rocking angle of the horizontal feed shaft 5 varies resulting in variation in the cloth feed amount of the upper layer feed dog 40 in the horizontal direction.

As clear from the foregoing description on one preferred embodiment of the upper layer feed mechanism of the present invention, since the upper feed dog 40 and the main feed dog 13 are disposed in face-to-face relationship to grip the cloth being sewn therebetween, the cloth feed amount by the upper feed dog 40 can be adjusted with respect to that by the main feed dog 13 and the upper feed dog 40 is adapted to feed the cloth in the horizontal direction in response to the horizontal movement of the main feed dog 13, even when the two layers of the cloth to be sewn together one upon another in the sewing area defined by the pressure foot and the sub-feed dog 14 tend to displace relative to each other, such relative displacement of the cloth layers can be compensated for or prevented by adjusting the cloth feed amount by the upper feed dog 40 corresponding to the displacement whereby a high quality cloth product can be obtained. And even when any variation occurs in the displacement amount of the cloth at the area of the sub-feed dog due to variation in the coefficient of friction of the cloth being depending upon the type of the cloth, by compensating for the cloth feed amount by the upper feed dog by manipulating the associated adjusting mechanism, a proper cloth feed amount can be obtained compensating for such displacement and thus a proper sewing can be always attained regardless of the type of the cloth. Therefore, the upper layer feed mechanism of the present invention is versatile. Furthermore, since the cloth feed amount by the upper feed dog 40 varies in proportion to variation in the cloth feed amount by the main feed dog 13, the operation and adjustment on the mechanism are easy.

While one embodiment of the invention has been shown and described in detail, it will be understood that the same is for illustration purpose only and not to be taken as a definition of the invention, reference being had for this purpose to the appended claims.

What is claimed is:

1. In a sewing machine comprising a machine frame, a drive shaft rotatably supported on said machine frame, a horizontal feed adjuster and an eccentric cam mounted on said drive shaft in spaced relationship to each other along the length of the shaft, the eccentricity of said adjuster and eccentric cam with respect to the drive shaft being adjustable, a horizontal feed shaft rockably supported on said machine frame and interlocked to said adjuster and main- and sub-feed dogs disposed on the opposite sides of the cloth feed path in said sewing machine below a cloth being sewn and interlocked to said horizontal feed shaft and eccentric cam for cloth feed movement, characterized by an upper layer feed mechanism comprising a first interlocking arm secured at one end to said horizontal feed shaft, an upper layer feed shaft rotatably supported at one end on said machine frame and having a second interlocking arm secured to the other end, a connector rod connecting between said first and second interlocking arms, an adjusting means adjusting the connection between said second interlocking arm and connector rod with respect to the axis of said horizontal feed shaft and having an adjusting member disposed out of said machine frame, a support arm rotatably supported at one end on said machine frame, an upper feed arm rotatably supported at one end on said support arm and having an upper layer feed dog at the other end above and facing said main feed dog, a connector means connecting between said upper feed shaft and support arm so as to transmit the rocking movement of the upper feed shaft to the support arm to thereby cause said upper layer feed dog to move in the same horizontal plane as said main feed dog, a resilient means normally urging downwardly said upper layer feed dog at said upper layer feed arm and a means rockable in response to the rotation of said drive shaft to cause said upper layer feed dog to raise said upper feed arm against the resiliency of said resilient means when main feed dog descends.

2. The upper layer feed mechanism as set forth in claim 1, in which said connector means comprises a feed arm secured at one end to said second interlocking arm and an upper layer feed rod connected at one end to said feed arm, and said adjusting means comprises an adjusting link connected to said upper layer feed shaft, a threaded bar connected to said adjusting link and an adjusting nut on said threaded bar.

* * * * *